US005454730A

United States Patent [19]

Tozuka

[11] Patent Number: 5,454,730

[45] Date of Patent: Oct. 3, 1995

[54] PLUG-IN CONNECTOR

[76] Inventor: Tadao Tozuka, 22-3, Sumiyoshi 1-chome, Hamamatsu-shi, Shizuoka, Japan

[21] Appl. No.: 133,649

[22] Filed: Oct. 7, 1993

[30] Foreign Application Priority Data

Mar. 18, 1993 [JP] Japan ..... 5-017807 U
May 31, 1993 [JP] Japan ..... 5-033468 U

[51] Int. Cl.[6] ..... H01R 4/48
[52] U.S. Cl. ..... 439/438; 439/441; 439/910
[58] Field of Search ..... 439/438, 439, 439/440, 441, 787, 786, 910

[56] References Cited

U.S. PATENT DOCUMENTS

| | | | |
|---|---|---|---|
| 3,560,632 | 2/1971 | Wallace | 439/910 X |
| 4,084,876 | 4/1978 | Dinger | 439/439 |
| 4,824,395 | 4/1989 | Blaha | 439/438 |

FOREIGN PATENT DOCUMENTS

| | | | |
|---|---|---|---|
| 0076151 | 7/1953 | Denmark | 439/441 |
| 1266847 | 4/1968 | Germany | 439/438 |
| 2826978 | 2/1979 | Germany | 439/441 |
| 2802686 | 7/1979 | Germany | 439/438 |
| 2900673 | 7/1980 | Germany | 439/438 |
| 0143715 | 9/1980 | Germany | 439/438 |
| 63-43810 | 11/1988 | Japan . | |
| 64-7581 | 2/1989 | Japan . | |
| 1-22228 | 6/1989 | Japan . | |
| 1-29738 | 9/1989 | Japan . | |

*Primary Examiner*—Z. R. Bilinsky
*Attorney, Agent, or Firm*—Blakely, Sokoloff, Taylor & Zafman

[57] ABSTRACT

A contact element of a plug-in connector in which the peeled portions of electric wires are inserted includes a substantially U-shaped conductive plate and a leaf-like spring member. The conductive plate is formed by bending and constituted by a proximal end portion having a plurality of electric wire insertion holes and long and short bent pieces bent at two edges of said proximal end portion. The leaf-like spring member has one end side caught by the long bent piece of the conductive plate and a plurality of strip-like tongue pieces that are to be engaged with the inner side of said short bent piece and extending obliquely from the other end side thereof toward the long bent piece.

8 Claims, 7 Drawing Sheets

PLUG-IN CONNECTOR

BACKGROUND OF THE INVENTION

The present invention relates to a plug-in connector capable of simply and appropriately connecting an electric wire with another electric wire only by inserting one end portion of the electric wire.

In a plug-in connector of this type, a contact element comprising a conductive plate for connecting electric wires with each other and a spring piece for urging an electric wire against the conductive plate is incorporated in a holder made of a heat-resistant insulating member. Wire connection can be easily performed by anybody only by peeling the coatings on the connection ends of electric wires to be connected and inserting the peeled portions through the insertion ports of the holder. Hence, plug-in connectors having various types of structures are conventionally known, e.g., one disclosed in Japanese Utility Model Publication Nos. 1-22228, 1-29738, and the like.

One of the requirements of this plug-in connector is a simple and assembly-facilitated pressure contact structure by means of the contact element of an electric wire. According to this structure, peeled portions of the electric wires as electric wire connection ends can be easily inserted in the holder, and after insertion, the peeled electric wire portions are reliably prevented from removal from the holder, so that the contact element and the electric wire peeled ends by pressure connection in this state can electrically contact each other with a high reliability.

More specifically, a conventional contact element comprising a conductive plate made of a copper member or the like and a leaf spring having a spring piece for urging the peeled electric wire portions against the conductive plate is used. Of the conventional contact elements, however, one which not only has a simple structure and can be assembled easily, but also can satisfy easy insertion of the peeled electric wire portions to be inserted, reliable electrical connection by ensuring a contact area and a contact pressure, and prevention of the inserted peeled electric wire portions from removal has not yet been proposed.

Especially, in most of the conventional contact elements, when the proximal end portion of a leaf spring is to be fixed on a conductive plate, a plurality of electric wire insertion holes are formed in one plate portion of an L-shaped bent conductive plate, a caulking piece is provided on the outer end of the conductive plate, and projecting portions provided to part of the caulking piece are caulked through holes formed in the leaf spring, thereby fixing the proximal end portion of the leaf spring on the conductive plate.

In the contact element employing caulking by means of the conductive plate and the leaf spring, electric wires are inserted in the electric wire insertion holes of the conductive plate, and the distal end portion of the leaf spring is urged against the inserted end sides of the electric wires, thereby electrically connecting the electric wires. At this time, when a force is applied in a direction to spread toward the electric wire receiving portions of the conductive plate and the distal end portion of the leaf spring, this force acts on the portions of the conductive plate having the electric wire insertion holes and the caulking portion of the leaf spring. Then, the portions of the conductive plate having the electric wire insertion holes and the caulking portion are deformed in a direction to move the distal end portion of the leaf spring away from the electric wires to decrease the pressure. As a result, the electrical conductivity is degraded.

Furthermore, in this conventional contact element, the following problem easily occurs. More specifically, the distal end side of the leaf spring can easily float from the conductive plate depending on the caulked state of the fixing portion fixed by caulking. Then, a gap between the leaf spring and the electric wire receiving portions of the conductive plate becomes larger than the diameter of the electric wires. Even when the electric wires are inserted, the leaf spring cannot firmly catch the electric wires. Removal of the electric wires may not be prevented.

An angle defined by the distal end side of the leaf spring, fixed by caulking to the conductive plate, and the conductive plate is significant in facilitating the plug-in operation of the electric wires and reliably preventing the electric wires from removal. More specifically, considering facilitation of wire insertion and reliable electrical connection of the electric wires, when the angle defined by the conductive plate and the leaf spring, both constituting the contact element, is set small, the function of the leaf spring that prevents the electric wires from removal is impaired. On the other hand, when the angle is set large in order to cause the leaf spring to firmly catch the electric wires and to reliably prevent the electric wires from removal, the electric wires cannot be easily inserted between the conductive plate and the leaf spring both constituting the electric wire contact element. In addition, a contact area cannot be ensured, thereby impairing electrical connection.

For this reason, the following structure has been conventionally proposed. According to this structure, a substantially U-shaped bent conductive plate and an almost V-shaped leaf spring incorporated inside the conductive plate are used. One plate portion of this leaf spring is arranged along the inner surface of one side portion of the conductive plate. The other plate portion of the leaf spring obliquely extends toward the other end portion thereof. When the peeled portions of the electric wires are inserted, the leaf spring is elastically deformed such that its bending angle is an acute angle. Then, the reactive force of the leaf spring urges the electric wire peel portions against the inner surface of the other side portion of the conductive plate.

With this structure, however, although the conductive plate and the leaf spring have a simple structure and can be assembled easily, there is a problem in obtaining the required clamped state of the electric wire peel portions. More specifically, when the peeled electric wire portions are inserted to flex the leaf spring at an acute angle, the reactive force of the leaf spring also acts on one bent side portion of the conductive plate to open the U-shaped conductive plate. Then, the clamped state of the peeled electric wire portions by means of the leaf spring cannot be maintained, and the reliability of the electrical connection of the electric wires cannot be ensured. In addition, the electric wires cannot be prevented from removal. Therefore, it is required to take a countermeasure that can solve all these problems.

Another one of the requirements of the plug-in connector described above is to recognize and discriminate whether the connecting ends of electric wires are reliably connected to each other by inserting them in the holder.

When the electric wires are not sufficiently inserted in the connector, not only the required reliability of connection between electric wires is impaired, but also defective contact can be easily caused, leading to a fire caused by heat generated by the defective contact.

For this reason, in order to prevent the erroneous insertion of the electric wires, for example, the following connector has already been proposed. According to this connector, an electric wire insertion identification piece that can be swung upon inserting an electric wire is provided to part of the holder of the connector. The motion of the identification piece is grasped visually or by the sense of touch.

However, if such an electric wire insertion identification piece or a window for externally confirming it is integrally formed in the holder or the like, a holder forming die tends to be complicated, resulting in an increase in cost. Therefore, it is also required to take some countermeasure to solve this problem.

SUMMARY OF THE INVENTION

It is, therefore, an object of the present invention to provide a plug-in connector which can constitute a contact element allowing electrical connection of peeled electric wire portions by combining a leaf-like spring member and a conductive plate which are easily formed by simple bending, while having good workability and easy assembly, and which can reliably clamp the peeled electric wire portions under pressure, thereby ensuring reliability of electrical connection.

It is another object of the present invention to provide a plug-in connector which can constitute a contact element by employing a leaf-like spring member and a conductive plate by simple bending, which can constitute a contact element that can electrically connect peeled portions of electric wires by pressure contact, very easily by incorporating the contact element in a holder made of a transparent synthetic resin material, and which can reliably recognize, discriminate, and check an inserted state of the electric wires in the holder.

In order to achieve these objects, according to the present invention, there is provided a plug-in connector comprising a contact element constituted by a conductive plate having insertion holes in which peeled portions of a plurality of electric wires are inserted, and a leaf-like spring member integrally mounted on the conductive plate and having a plurality of tongue pieces for urging the inserted peeled electric wire portions against part of the conductive plate, and a holder for incorporating the contact element and made of a synthetic resin material having a heat-resistant insulating property, wherein the conductive plate is made of at least a first plate portion and a second plate portion bent with respect to the first plate portion, the first plate portion having the insertion holes formed therein, and the leaf-like spring member has one end hooked and locked by a distal end side of the second plate portion of the conductive plate, the other end having the tongue pieces for urging the inserted peeled electric wire portions against the second plate portion of the conductive plate, and a folded portion formed at least at one portion between one end and the other end of the leaf-like spring member, the folded portion being embraced and held by a bent portion formed on a distal end side of the first plate portion so as to be integrally mounted on the conductive plate.

DESCRIPTION OF THE PREFERRED EMBODIMENTS

Figure 1:
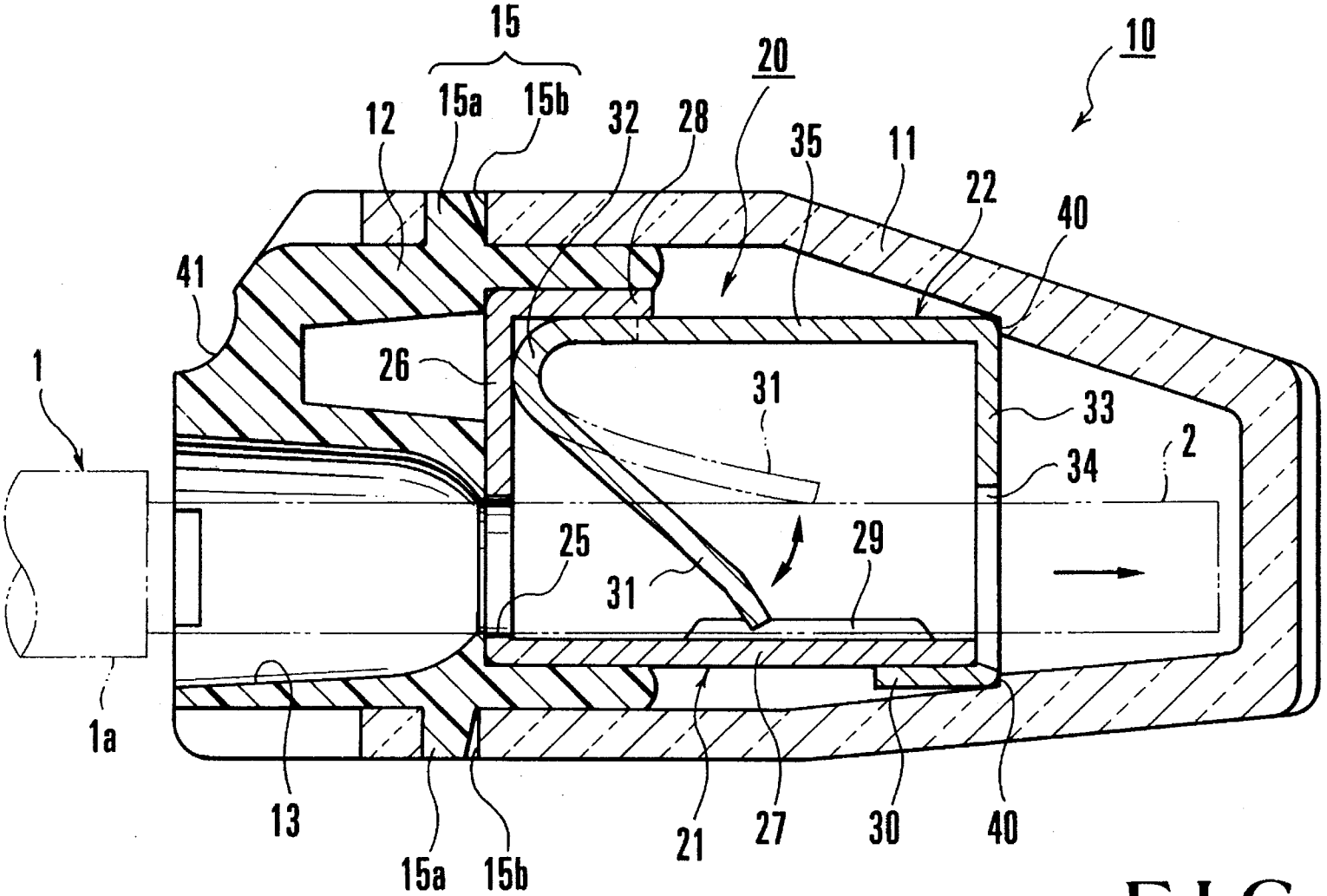
FIG. 1 is a sectional view of the main part of a plug-in connector according to an embodiment of the present invention, showing a state wherein an electric wire is not inserted and a state wherein an electric wire is inserted.

FIGS. 1 to 5 show a plug-in connector according to an embodiment of the present invention. In FIGS. 1 to 5, this embodiment exemplifies a plug-in connector of a type for connecting three electric wires 1. Single-core electric wires are generally used as the electric wires 1. As is known well, the insertion ends of the electric wires 1 serving as the connection ends to be connected to the connector are prepared as peeled portions 2 obtained by peeling insulating coatings 1*a*.

As is apparent from FIGS. 1 to 4, a plug-in connector 10 comprises a holder 11 and a cap 12. The holder 11 is integrally made of a heat-resistant insulating synthetic resin material to have a substantially box-like shape. The cap 12 is made of a heat-resistant insulating synthetic resin material, as in the holder 11, to close the end open to the electric wire insertion end of the holder 11. Three electric wire insertion ports 13 into which the peeled electric wire portions 2 of the electric wires 1 are inserted as needed are formed in the cap 12.

The cap 12 is locked by appropriate removal preventive means 15 (engaging projections 15*a* and engaging holes 15*b*) as it is fitted in the open end of the holder 11, so that it is integrally formed with the holder 11. The outer end side of each electric wire insertion port 13 formed in the cap 12 has a larger diameter so that each electric wire insertion port 13 has a substantially horn-like shape. Hence, the electric wires 1 can be easily inserted into the electric wire insertion ports 13.

Figure 4:
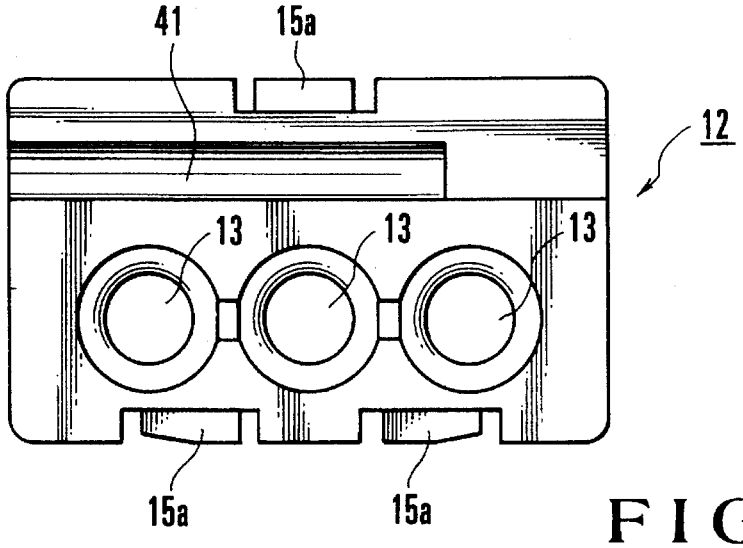
FIG. 4 is a schematic front view of the cap of the plug-in connector shown in FIG. 1.

In this embodiment, as is apparent from FIG. 4, one engaging projection 15*a* is formed on one side of the cap 12, and two engaging projections 15*a* are formed on the other side of the cap 12 in a staggered manner. This aims at preventing the cap 12 from being mounted upside down when the cap 12 is to be mounted on the holder 11 after a contact element 20 (to be described later) is incorporated in the holder 11, thereby obtaining good workability and high reliability.

The contact element 20 is disposed in an internal space 14 formed in the holder 11 closed by the cap 12, and clamps the peeled electric wire portions 2 under pressure, thereby electrically connecting the electric wires 1 to each other (not shown). As is apparent from FIGS. 1 to 3, the contact element 20 is constituted by a conductive plate 21 and a leaf-like spring member 22. The conductive plate 21 is formed of a substantially U-shaped bent conductive plate member, e.g., a copper plate plated with tin or the like. The leaf-like spring member 22 is integrally mounted on and held by the conductive plate 21 and clamps the peeled electric wire portions 2 together with the conductive plate 21 under pressure, thereby electrically connecting the electric wires 1 to each other.

Figure 2:
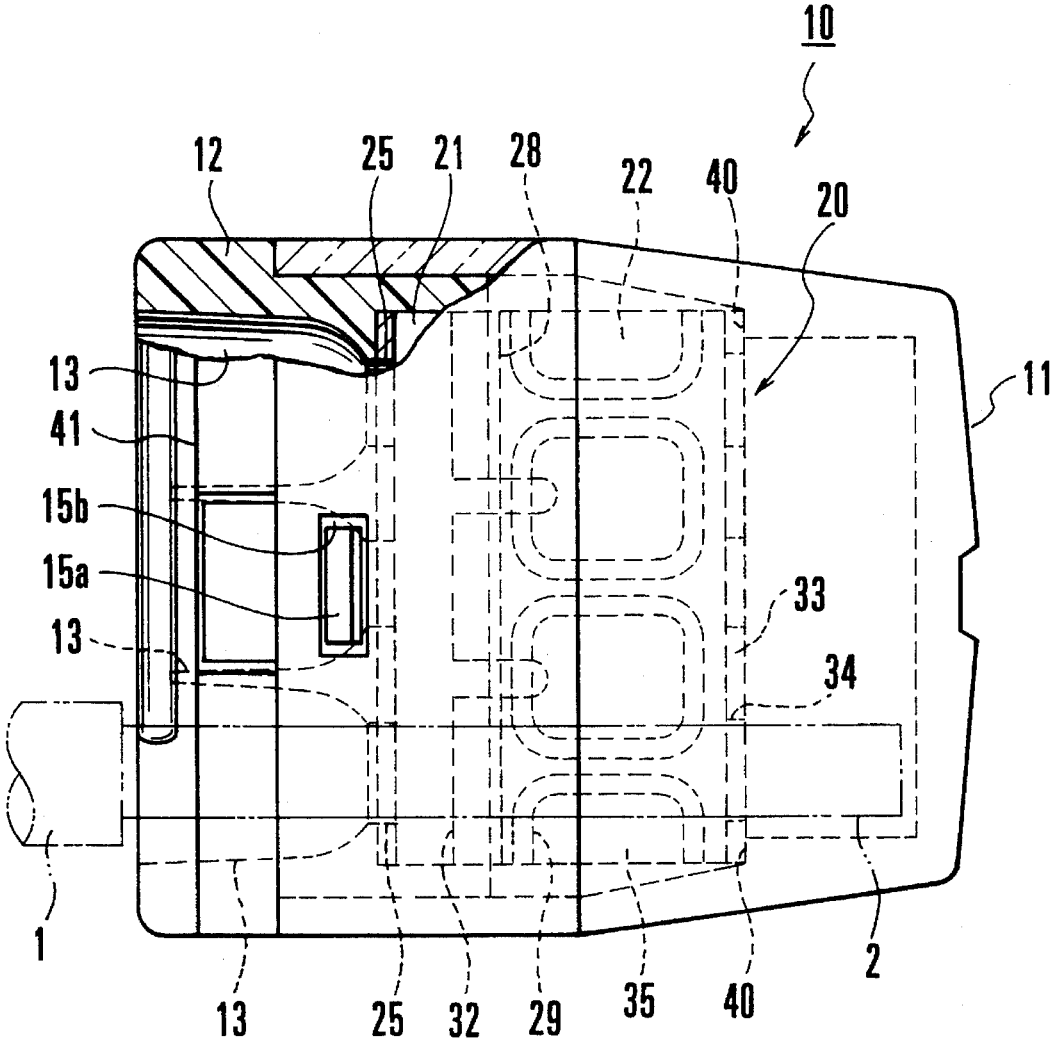
FIG. 2 is a schematic plan view of the plug-in connector shown in FIG. 1.
Figure 3A:
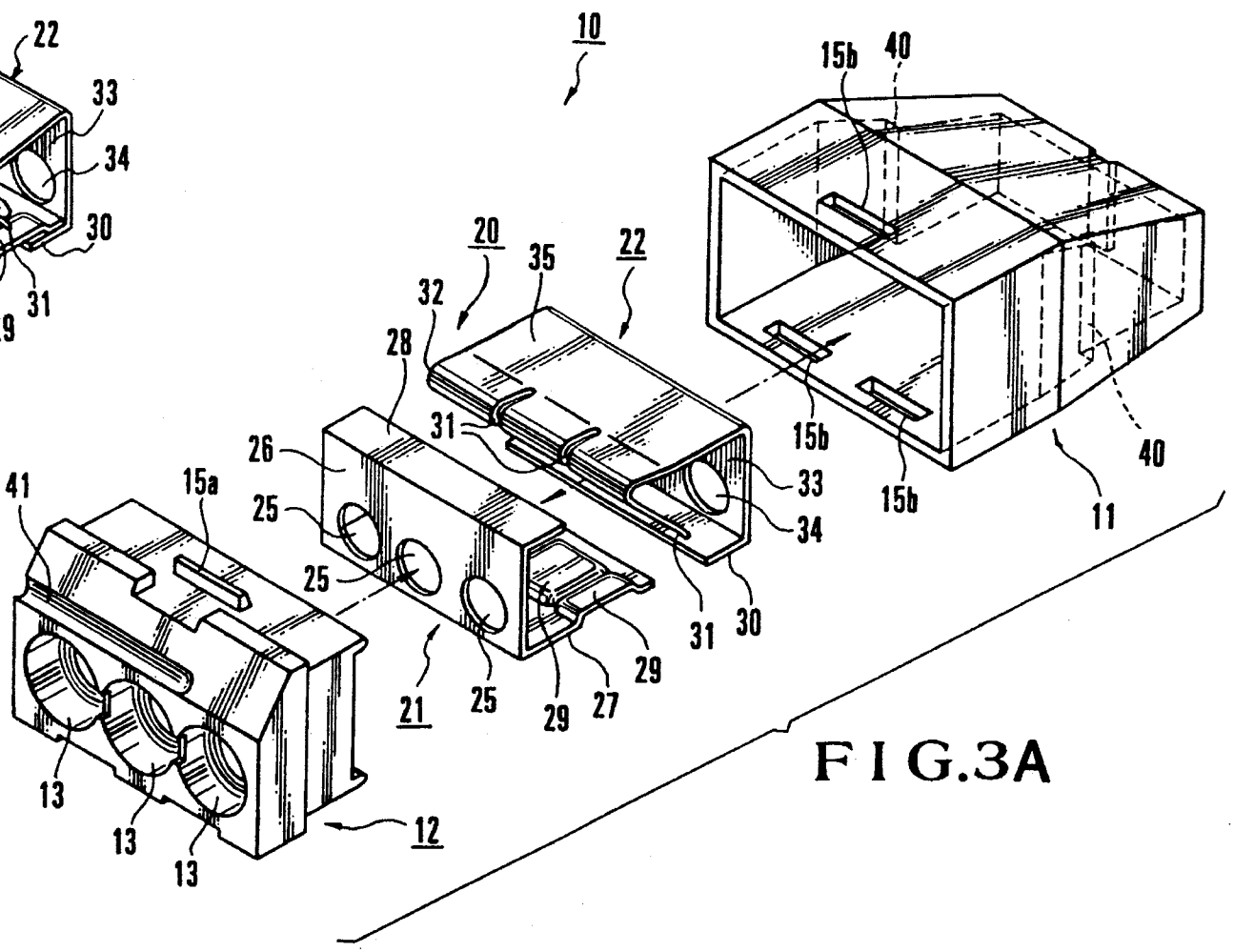
FIG. 3 is a schematic exploded perspective view of the plug-in connector shown in FIG. 1.
Figure 3B:
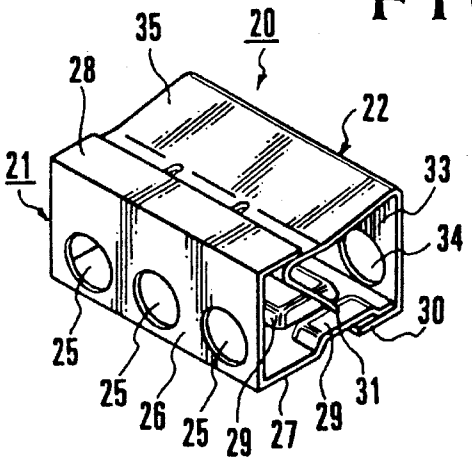

According to this embodiment, the conductive plate 21 and the leaf-like spring member 22 are formed to have a shape as shown in FIGS. 1 to 3 and assembled integrally, thereby forming the contact element 20.

More specifically, as is apparent from FIGS. 1 to 3, the substantially U-shaped conductive plate 21 comprises a proximal end portion 26 and long and short bent pieces 27 and 28. A plurality (three) of electric wire insertion holes 25 corresponding to the electric wire insertion ports 13 are formed in the proximal end portion 26 so that the peeled electric wire portions 2 can be inserted therein. The long and short bent pieces 27 and 28 are formed by bending the two edges of the proximal end portion 26 in an electric wire insertion direction.

Figure 5:
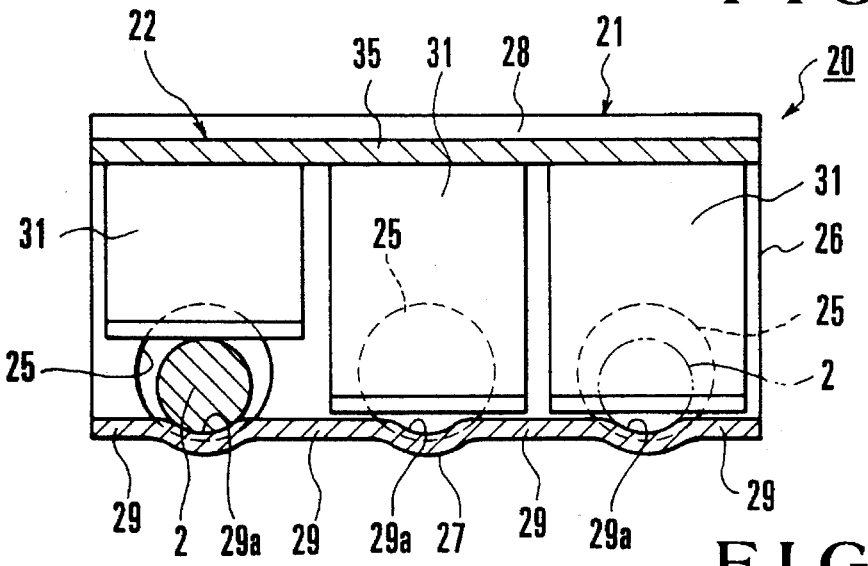
FIG. 5 is a sectional view of the main part of a contact element used in the plug-in connector shown in FIG. 1.

Reference numerals 29 denote a plurality of projecting portions. The projecting portions 29 are formed on the long bent piece 27 such that the central portions of the electric wire insertion holes 25 constitute V-shaped guide grooves 29*a*, as shown in FIG. 5. When the peeled electric wire portions 2 are inserted along the groove portions between the projecting portions 29 through the electric wire insertion holes 25 and urged by the tongue pieces (to be described later) of the leaf-like spring member 22, the projecting portions 29 increase the contact portion between the conductive plate 21 and the peeled electric wire portions 2, so that electrical connection can be reliably achieved.

As is apparent from FIGS. 1 and 3, the leaf-like spring member 22 has a catch piece 30 on its one end side to be caught by the distal end of the long bent piece 27 of the conductive plate 21. The other end side of the leaf-like spring member 22 forms strips to constitute a plurality of tongue pieces 31 serving as electric wire pressure contact pieces. This other end side of the leaf-like spring member 22 extends obliquely downward in a tilted manner as its folded portion 32 is engaged with the inner side of the corner portion of the short bent piece 28 of the conductive plate 21.

In this embodiment, the overall leaf-like spring member 22 substantially has a trapezoidal shape, wherein part thereof having the catch piece 30 on its one side stands upright in a direction perpendicular to the electric wire insertion direction and then is bent in the electric wire insertion direction to reach the folded portion 32.

More specifically, referring to FIG. 3, reference numeral 33 denotes a wall portion extending perpendicularly to the electric wire insertion direction. Second electric wire insertion holes 34 are formed in the wall portion 33 to oppose the electric wire insertion holes 25 of the proximal end portion 26 of the conductive plate 21. Hence, the peeled electric wire portions 2 extend through the contact element 20 consisting of the conductive plate 21 and the leaf-like spring member 22. At this time, the peeled electric wire portions 2 can have an appropriate electrical contact state within the contact element 20.

Reference numeral 35 denotes a resilient piece portion extending from the wall portion 33 toward the folded portion 32 in the electric wire insertion direction.

The conductive plate 21 and the leaf-like spring member 22 having the above arrangements are assembled as they are integrally combined when the catch piece 30 of the leaf-like spring member 22 is caught by the distal end of the long bent piece 27 of the conductive plate 21, the folded portion 32 of the leaf-like spring member 22 is engaged with and held by the short bent piece 28 of the conductive plate 21, and the plurality of tongue pieces 31 are urged against the long bent piece 27 with a predetermined resilient force. More specifically, this contact element 20 has a stable combination of two members that can be obtained by simple bending.

Step portions 40 are formed on the inner wall portion of the holder 11 to define the incorporating position of the contact element 20 in the deep portion of the holder 11. The left side in FIG. 1 of the contact element 20 incorporated in the holder 11 is locked by the inner end of the cap 12 which is fitted in and locked by the open end of the holder 11. Hence, the contact element 20 is prohibited from moving in the holder 11, so that it is incorporated in the holder 11 without a backlash.

With this arrangement, when the peeled electric wire portions 2 are inserted into the holder 11 of the plug-in connector 10 and clamped under pressure between the conductive plate 21 and the leaf-like spring member 22 that constitute the contact element 20, the contact element 20 does not cause any backlash. Therefore, the insertion operation of the peeled electric wire portions 2 can be easily performed, and a predetermined clamped state can be obtained.

Especially, in the contact element 20 described above, the electric wire insertion holes 25 and 34 for inserting the peeled electric wire portions 2 therethrough are formed in the conductive plate 21 and the leaf-like spring member 22, respectively. Since the peeled electric wire portions 2 are inserted such that they extend through the contact element 20, the leaf-like spring member 22 having the tongue pieces 31 and the like are not excessively urged in the holder 11. Therefore, the respective portions will not be deformed excessively, which is advantageous in terms of the service life.

In this contact element 20, the strip-like tongue pieces 31 of the leaf-like spring member 22 firmly catch the peeled electric wire portions 2, that are being inserted along the inner side surface of the long bent piece 27 of the conductive plate 21, such that they apply a resilient force to the peeled electric wire portions 2, and urge the peeled electric wire portions 2 against the long bent piece 27, thereby assuring the electrical contact state and to prevent the peeled electric wire portions 2 from removal.

In this embodiment, as is apparent from FIGS. 1 to 4, a recessed checking groove portion 41 is formed in the front surface portion of the insertion side of the cap 12 in order to serve as the standard to measure the length of the peeled portions 2 of the electric wires 1 that are inserted in the plug-in connector 10.

With this arrangement, the length of the coatings to be removed from the insertion end portions of the electric wires 1 that are to be connected by the plug-in connector 10 of this type can be determined to a substantially constant value. The peeling amount of the insulating coatings 1*a* may be adjusted in accordance with this substantially constant value, and thereafter the electric wires 1 may be inserted into the plug-in connector 10.

Conventionally, the recessed checking groove portion 41 is generally formed in the side surface portion or the like of the holder 11. In this case, however, when the electric wires 1 are to be inserted, the connector 10 must be passed from one hand to the other hand to adjust the length of the coatings to be removed from the insertion end portions of the electric wires 1, inevitably resulting in a cumbersome operation. In the arrangement of this embodiment, the peeling length of the peeled portions 2 of the electric wires 1 can be adjusted or the peeled electric wire portions 2 can be inserted while the electric wires 1 oppose the insertion surface of the holder 11, thus providing a large practical advantage.

Furthermore, according to this embodiment, in the connector 10 described above, the proximal end portion 26 of the conductive plate 21 and the wall portion 33 of the leaf-like spring member 22 are arranged to block the electric wire insertion direction. The first and second electric wire insertion holes 25 and 34 are formed in the proximal end portion 26 and the wall portion 33, respectively, so that the peeled electric wire portions 2 clamped with pressure between the conductive plate 21 and the leaf-like spring member 22, that constitute the contact element 20 incorporated in the holder 11, extend through the holes 25 and 34. The peeled electric wire portions 2 are thus held by the electric wire insertion holes 25 and 34 to extend through the conductive plate 21 and the leaf-like spring member 22. The holder 11 is made of a transparent synthetic resin material so that the interior of the holder 11 can be visually confirmed.

With this arrangement, the coatings on the insertion ends of the electric wires 1 to be connected are peeled. The peeled electric wire portions 2 are inserted into the insertion ports 13 of the cap 12 and urged under pressure by the strip-like tongue pieces 31 of the leaf-like spring member 22 against the conductive plate 21 of the contact element 20 incorporated in the holder 11, so that the electric wires 1 can be electrically connected to each other. In the insertion operation, when the inserted electric wires 1 extend through the contact element 20 as they are clamped under pressure by the contact element 20, the distal ends of the peeled portions 2 of the electric wires 1 can be visually confirmed through the transparent holder 11, as is apparent from FIGS. 1 and 2. Therefore, the inserted state of the electric wires 1 can be easily and reliably confirmed from the outside of the holder 11.

The present invention is not limited to the structure of the above embodiment. The shape and structure of the respective portions, e.g., the conductive plate 21 and the leaf-like spring member 22 constituting the contact element 20, may be appropriately modified and changed. Various modifications may be made regarding the shape and structure of the holder 11, the cap 12, and the like constituting the plug-in connector 10.

For example, in the above embodiment, the cap 12 is provided to close the open end of the holder 11. However, if the contact element 20 itself can be housed and held in the holder 11 such that it will not be removed, the cap 12 can be omitted.

Figure 6:
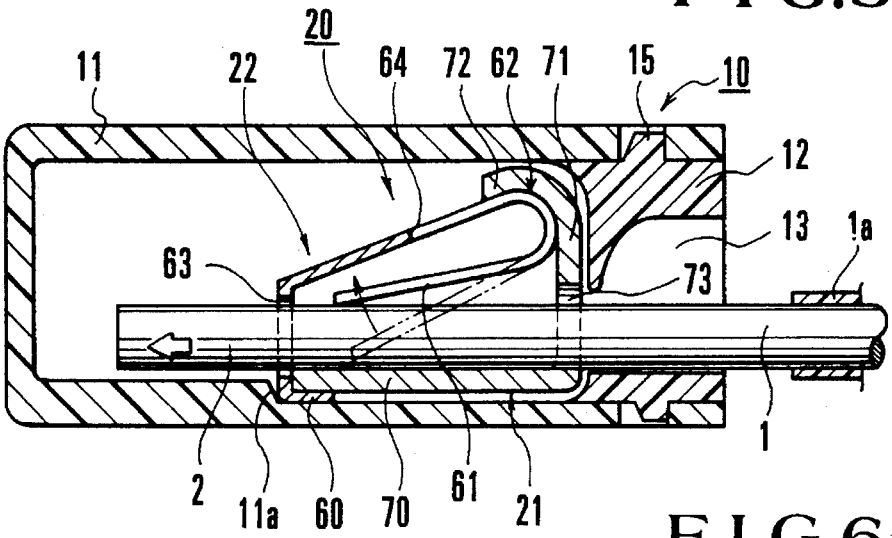
FIG. 6 is a sectional view of a main part of a plug-in connector according to another embodiment of the present invention.
Figure 7:
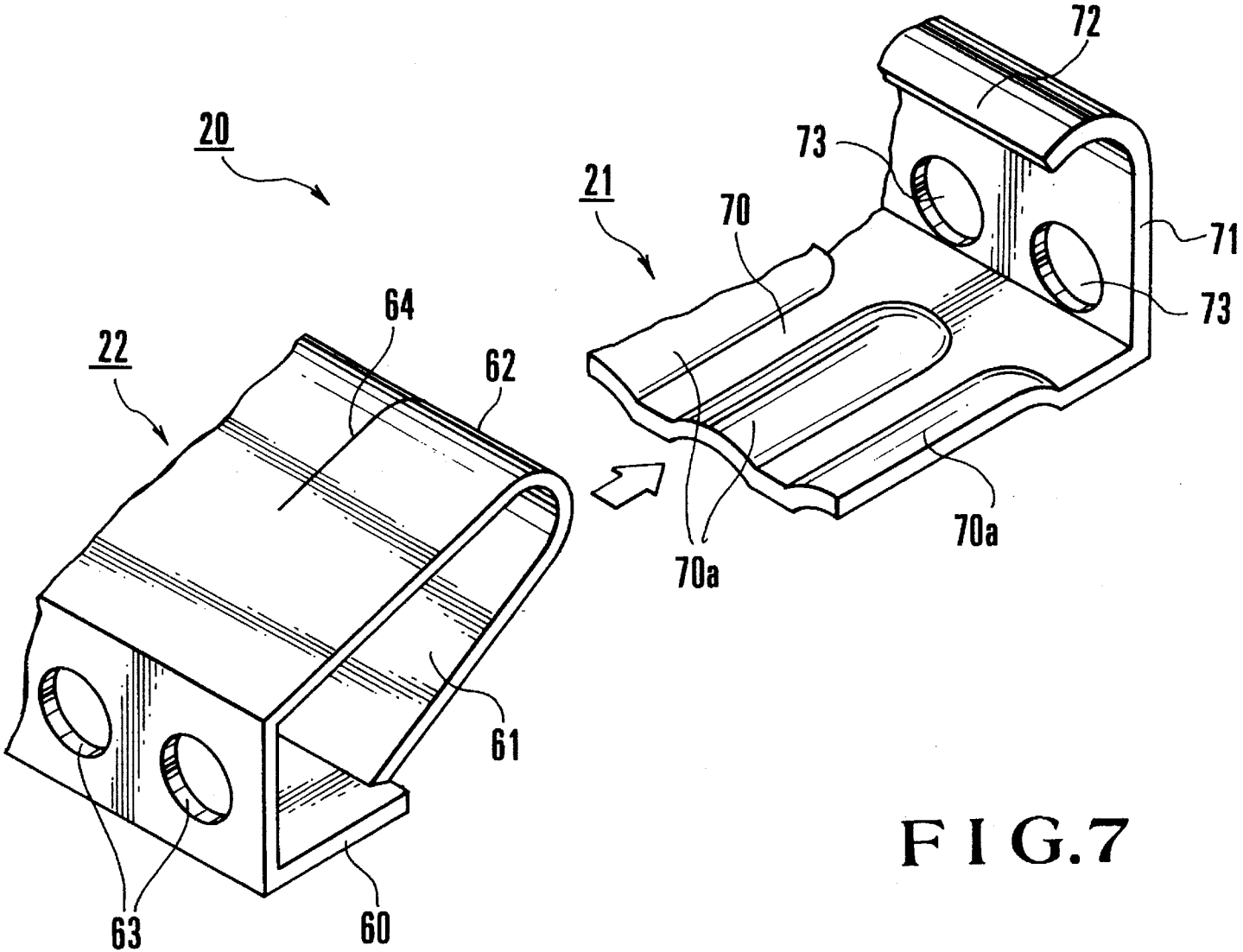
FIG. 7 is a schematic exploded perspective view showing the arrangement of the main part of a conductive plate and a leaf-like spring member constituting the contact element of the plug-in connector shown in FIG. 6.

FIGS. 6 and 7 show a plug-in connector according to another embodiment of the present invention. The same or corresponding portions as in the embodiment described above are denoted by the same reference numerals, and a detailed description thereof will be omitted.

In this embodiment, as is apparent from FIGS. 6 and 7, a contact element 20, which is disposed in a holder 11 for clamping respective peeled electric wire portions 2 under pressure, thereby electrically contacting electric wires 1 (not shown) to each other, is constituted by a conductive plate 21 and a leaf-like spring member 22. The substantially U-shaped conductive plate 21 is obtained by bending a conductive plate member, e.g., a copper plate plated with tin or the like. The leaf-like spring member 22 is integrally mounted on and held by part of the conductive plate 21 and urges the peeled electric wire portions 2 against the conductive plate 21, thereby electrically connecting the electric wires 1 to each other.

Figure 8:
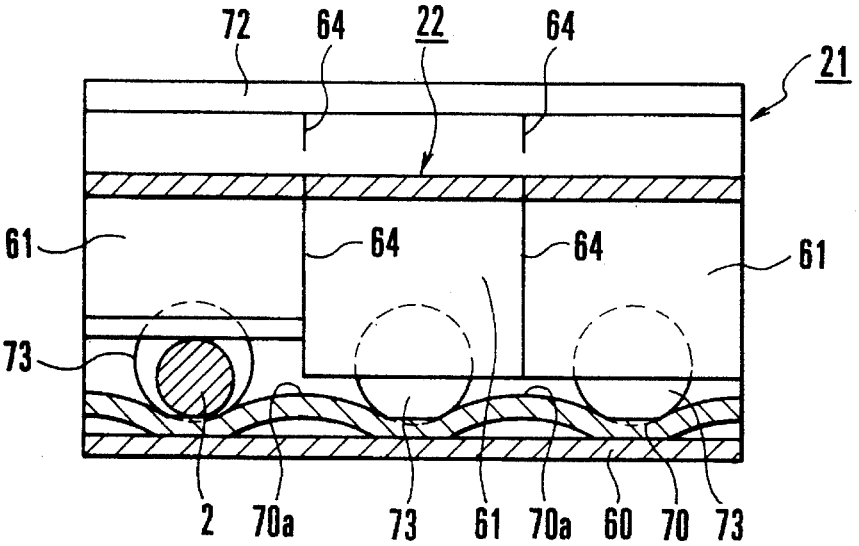
FIG. 8 is a schematic front view of a state wherein electric wires are inserted in the contact element of FIG. 7.

In this embodiment, as is apparent from FIGS. 6, 7, and 8, a hook-like catch portion 60 is formed on one end of the leaf-like spring member 22 described above, and a plurality of strip-like tongue pieces 61 are formed on the other end of the leaf-like spring member 22. The tongue piece forming portion of the leaf-like spring member 22 is bent toward the hook-like catch portion 60 through a folded portion 62.

Reference numeral 63 denotes three electric wire insertion holes formed parallel to each other in the proximal end portion standing upright from the hook-shaped catch portion 60; and 64, incisions defining the tongue pieces 61.

As is apparent from FIGS. 6, 7, and 8, the conductive plate 21 is bent to have a substantially L shape as a whole. The hook-like catch portion 60 of the leaf-like spring member 22 is hooked and locked by one end portion (the distal end portion of one plate portion 70) of the conductive plate 21. A bent portion 72 which is bent inward is formed on the other end portion (the end portion of the other plate portion 71) of the conductive plate 21 to embrace and hold the folded portion 62.

Reference numerals 73 denote electric wire insertion holes 73 formed parallel to each other in the other plate portion 71 and in which the peeled electric wire portions 2 are inserted.

In this conductive plate 21, as is apparent from FIGS. 7 and 8, portions of one plate portion 70 not corresponding to the electric wire insertion holes 73 are swelled, thereby forming ridge portions 70*a* for defining guide grooves (omitted in FIG. 6) that guide the peeled electric wire portions 2.

With this conductive plate 21, when the peeled electric wire portions 2 are sequentially inserted through the plurality of electric wire insertion holes 73 formed in the other plate portion 71, the electric wires 1 are clamped under pressure between one plate portion 70 of the conductive plate 21 and the elastically deformable tongue pieces 61 of the leaf-like spring member 22, thereby connecting the electric wires 1 to each other.

More specifically, with the contact element 20 having the arrangement described above, the leaf-like spring member 22, having one end formed with the hook-like catch portion 60 and the other end formed with a plurality of strip-like tongue pieces 61 through the folded portion 62, and the conductive plate 21, having one end portion 70 for catching the hook-like catch portion 60 and the other end portion 71 bent to embrace the folded portion 62, can be formed by simple bending, and can be integrally assembled by a simple combining operation.

When the folded portion 62 of the leaf-like spring member 22 is embraced and held by the bent portion 72 of the conductive plate 21, the plurality of tongue pieces 61 serve as the electric wire urging pieces that are elastically deformed by inserting the peeled electric wire portions 2.

When the peeled electric wire portions 2 are clamped under pressure between the plurality of tongue pieces 61 and one plate portion 70 of the conductive plate 21, the peeled electric wire portions 2 can be electrically connected to each other, as indicated by an imaginary line in FIG. 6.

The hook-like catch portion 60 of the leaf-like spring member 22 to be caught by the distal end of one plate portion 70 of the conductive plate 21 is clamped between a step portion 11*a* formed on the bottom portion of the holder 11 and a cap 12, so that it is integrally assembled with the conductive plate 21 such that it will not be disengaged from the conductive plate 21.

Especially, with the above arrangement, one end of the leaf-like spring member 22 is hooked by the distal end of one plate portion 70 of the conductive plate 21 through its hook-like catch portion 60, and the folded portion 62, extending obliquely upward on one plate portion 70 of the conductive plate 21, in which the peeled electric wire portions 2 are inserted, is embraced and held by the buckled portion 72 formed on the distal end portion of the other plate portion 71, so that the strip-like tongue pieces 61 are stably mounted on and held by the conductive plate 21.

More specifically, when the peeled electric wire portions 2 are inserted into the contact element 20 disposed in the holder 11, the tongue pieces 61 of the leaf-like spring member 22 firmly catches the peeled electric wire portions 2 while applying, as the electric wire pressure contact pieces, a resilient force to the peeled electric wire portions 2, as indicated by the imaginary line in FIG. 6. Hence, the peeled electric wire portions 2 are urged against one plate portion 70 of the conductive plate 21 so that electrical contact is ensured and the peeled electric wire portions 2 are prevented from removal.

At this time, one end of the conductive plate 21 is caught by the hook-like catch portion 60 of the leaf-like spring member 22, and the folded portion 62 of the leaf-like spring member 22 that has the strip-like tongue pieces 61 on its distal end side can be stably locked and held by the bent portion 72 formed on the other end of the conductive plate 21 regardless of the swinging displacement of the tongue pieces 61.

In this embodiment, the number of plate members forming the leaf-like spring member 22 and then the conductive plate 21 can be smaller than that in the embodiment described above, thereby not only improving the workability but also decreasing the material cost and the like.

In this embodiment, the electric wire insertion holes 63 are formed in the proximal end portion of the leaf-like spring member 22 and the peeled electric wire portions 2 are inserted to extend also through these holes 63. However, the electric wire insertion holes 63 can be omitted. Then, the holder 11 can be decreased in size to obtain a compact plug-in connector 10.

Furthermore, the hook-like catch portion 60 of the leaf-like spring member 22 to be hooked and locked by one end of the conductive plate 21 is clamped between the inner walls of the holder 11 and stably incorporated in and held by the step portion 11*a* and the cap 12, thereby maintaining the state wherein it is integrally mounted on the conductive plate 21.

The holder 11 may be formed of a transparent synthetic resin material so that the distal end portions of the peeled electric wire portions 2 inserted in the contact element 20 and clamped under pressure can be visually observed from the outside. Then, the inserted state of the electric wires 1 can be visually confirmed very easily from the outside.

Figure 9:
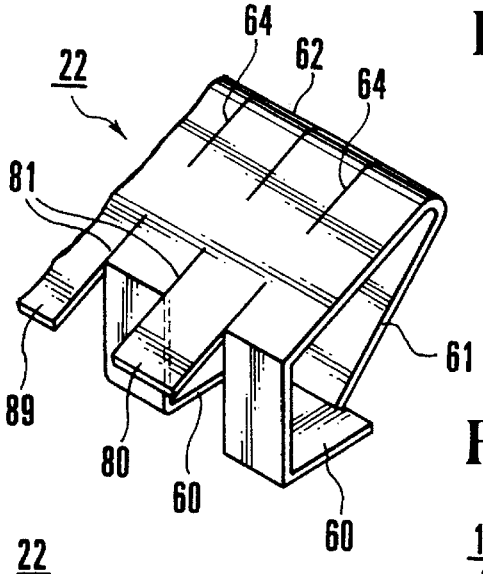
FIG. 9 is a schematic perspective view of a leaf-like spring member according to still other embodiment of the present invention.
Figure 10:
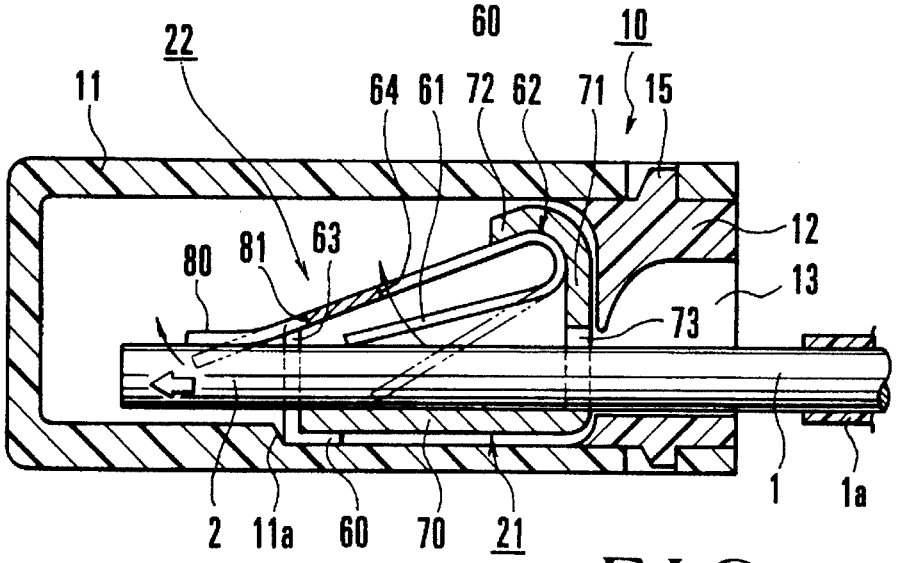
FIG. 10 is a sectional view of the main part of a plug-in connector according to the embodiment of the present invention of FIG. 9, showing a state wherein an electric wire is inserted and a state wherein an electric wire is not inserted.

FIGS. 9 and 10 show a plug-in connector according to still another embodiment of the present invention. In addition to tongue pieces 61 serving as the electric wire pressure contact pieces, incisions 81 are also formed in the end portion of a leaf-like spring member 22 identical to that of the embodiment described above on which the hook-like catch portion 60 is formed, thereby forming strip-like portions.

Every other strip-like portion is bent to form a hook-like catch portion 60. The remaining strip-like portions not forming the hook-like catch portions 60 are bent to extend obliquely downward, thereby forming second tongue pieces 80 for urging the peeled electric wire portions 2.

When this arrangement is employed, as is apparent from FIGS. 9 and 10, the electric wire urging function can be obtained also by the second tongue pieces 80 made by simple bending, so that electrical contact with the peeled electric wire portions 2 can be achieved more reliably. Furthermore, openings for forming the tongue pieces 80 can also be utilized as the electric wire insertion ports, thereby simplifying the arrangement.

Figure 11:
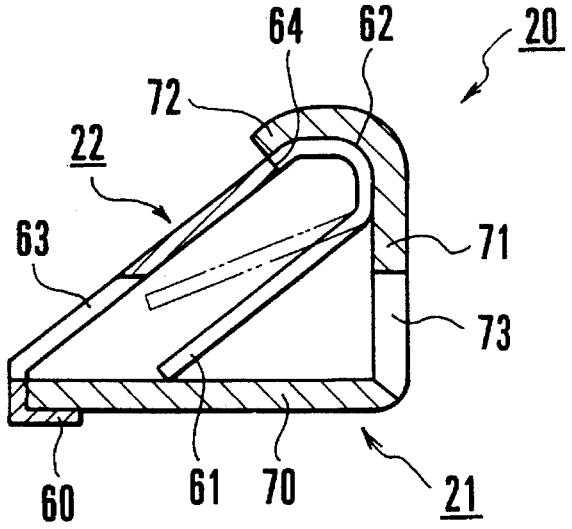
FIG. 11 is a schematic sectional view showing a contact element according to still another embodiment of the present invention.

The present invention is not limited to the arrangements of the embodiments described above. For example, as shown in FIG. 11, a leaf-like spring member 22 may have a shape to extend obliquely upward from a hook-like catch portion 60, and strip-like tongue pieces 61 may be formed through a folded portion 62 on the distal end side of the leaf-like spring member 22. In this case, electric wire insertion holes 63 may be formed in the oblique portion of the inclined leaf-like spring member 22.

Figure 12A:
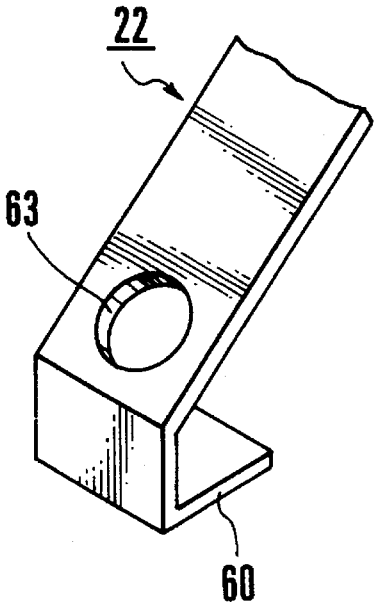
FIGS. 12A and 12B are schematic perspective views showing modifications of a conductive plate constituting the contact element of the present invention.
Figure 12B:
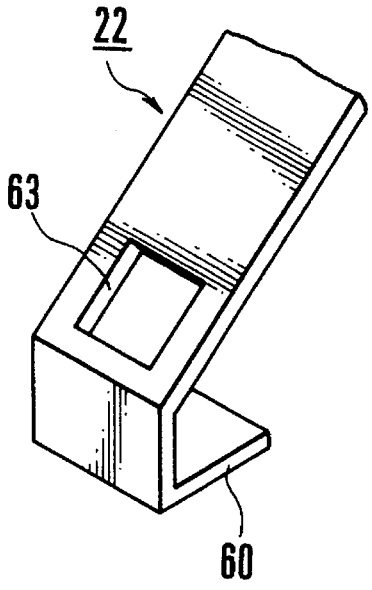

As shown in FIGS. 12A and 12B, the electric wire insertion holes 63 may be round or square holes, as a matter of course.

The plug-in connector according to the present invention having the above arrangement comprises a contact element having a conductive plate and a leaf-like spring member, and a holder for incorporating the contact element. The conductive plate is bent to have a substantially U shape constituted by a proximal end portion having a plurality of electric wire insertion holes and long and short bent pieces bent at two edges of the proximal end portion. The leaf-like spring member has one end side hooked by the long bent piece of the conductive plate. A plurality of strip-like tongue pieces to be engaged with an inner side of the short bent piece extend obliquely from the other end side of the leaf-like spring member toward the long bent piece. Since second electric wire insertion holes are formed in part of the leaf-like spring member to oppose the electric wire insertion holes in the proximal end portion of the conductive plate, excellent effects can be obtained as follows despite the simple arrangement.

More specifically, the conductive plate and the leaf-like spring member both constituting the contact element are simplified, so that the contact element facilitating electric connection of electric wires to each other can be obtained with simple bending and combining operations. The tongue pieces of the leaf-like spring member firmly catch the peeled electric wire portions at a required pressure, thereby urging the peeled electric wire portions, so that the electric wires can be electrically connected by the contact element in a required state. Therefore, requirements for reliable electrical connection and prevention of removal of the electric wires by means of appropriate catching can be satisfied.

According to the present invention, a contact element for connecting electric wires with each other is constituted by a leaf-like spring member and a conductive plate. The leaf-like spring member has a hook-like catch portion formed by bending at one end thereof and a plurality of tongue pieces that are formed at the other end thereof to have a strip shape. The tongue pieces are bent toward the hook-like catch portion through a folded portion. The conductive plate is formed by bending to have a substantially L shape. One end portion of the conductive plate hooks and locks the hook-like catch portion. The other end portion of the conductive plate forms a portion bent inwardly. The bent portion embraces and holds the folded portion of the leaf-like spring member. Therefore, despite the simple and inexpensive arrangement, the contact element for clamping the inserted electric wires under pressure can be constituted very simply such that it can reliably connect the electric wires under pressure. This contact element is excellent in terms of workability, assembly, and cost performance.

Furthermore, according to the present invention, in addition to the arrangements described above, one end portion of the leaf-like spring member is formed to have strips. Every other strip forms a hook-like catch portion, and the remaining strips form second tongue pieces to urge against the peeled electric wire portions. Therefore, in addition to the advantages described above, electrical connection between the peeled electric wire portions to each other and a function of preventing the electric wires from removal by means of catching can be enhanced more reliably.

Furthermore, according to the present invention, the holder for incorporating the contact element described above is made of a transparent heat-resistant insulating synthetic resin material so that the distal ends of the peeled electric wire portions extending through the contact element from the electric wire insertion holes can be visually confirmed from the outside of the holder. Therefore, despite the simple and inexpensive arrangement, in inserting the peeled electric wire portions, when the inserted electric wires extend through the contact element while they are urged by the contact element, the distal ends of the peeled electric wire portions are visually confirmed through the transparent holder, so that confirmation of the electric wire insertion operation can be simply and reliably performed from the outside of the holder.

What is claimed is:

1. A plug-in connector comprising:

a contact element constituted by a conductive plate having electric wire insertion holes in which peeled portions of a plurality of electric wires are inserted, and a leaf-like spring member integrally mounted on said conductive plate and having a plurality of tongue pieces for urging the inserted peeled electric wire portions against part of said conductive plate; and a holder for incorporating said contact element and made of a synthetic resin material having a heat-resistant insulating property, wherein said conductive plate forming a substantially C-shaped bend having a proximal end portion with a plurality of electric wire insertion holes and first and second bent pieces arranged at both sides of said proximal end portion, one end of said leaf-like spring member forming a bent piece and said bent piece of said leaf-like spring member hooked at the distal end outer side of the first bent piece of said conductive plate, the other end of the leaf-like spring member forming said plurality of tongue pieces, the leaf-like spring member further having folded portions formed between said bent piece of said leaf-like spring member and said tongue pieces, said folded portions engaging an inner side of said second bent piece, the plurality of said tongue pieces of the leaf-like spring member being formed between said folded portions and the end opposite said bent piece of said leaf-like spring member, said tongue pieces extending obliquely toward the distal end of said first bent piece for clamping said peeled portions of said electric wires under pressure on the first bent piece of said conductive plate, said leaf-like spring member integrally mounted on said conductive plate as a unit of the contact element, said folded portions being embraced and held by said second bent piece and said peeled portions of said electric wires capable of insertion, from the direction which is almost opposite to the power direction working on said folded portions through said tongue pieces.

2. A connector according to claim 1, wherein distal ends of the peeled electric wire portions extend through said electric wire insertion holes, and said holder for incorporating said contact element is made of a transparent heat-resistant insulating synthetic resin material so that the distal ends of the peeled electric wire portions extending through said contact element can be visually confirmed from an outside of said holder.

3. A connector according to claim 1, wherein said leaf-like spring member constituting said contact element has, as part thereof, second electric wire insertion holes to oppose the electric wire insertion holes in said proximal end portion of said conductive plate.

4. A connector according to claim 3, wherein said holder for incorporating said contact element is made of a transparent heat-resistant insulating synthetic resin material so that distal ends of the peeled electric wire portions extending through said contact element from the second electric wire insertion holes can be visually confirmed from an outside of said holder.

5. A connector according to claim 1, wherein said contact element comprises said leaf-like spring member having a hook-like catch portion formed by bending at one end thereof and said plurality of tongue pieces that are formed to have a strip shape at the other end thereof, said tongue pieces being bent toward said hook-like catch portion through said folded portion, and said conductive plate having one end portion for hooking and locking said hook-like catch portion of said leaf-like spring member and a bent portion formed bent inward at the other end portion thereof in order to embrace and hold said folded portion of said leaf-like spring member, and the peeled electric wire portions are inserted through the plurality of electric wire insertion holes formed in a plate portion on the other end portion of said conductive plate so as to be clamped under pressure between a plate portion on one end portion of said conductive plate and said tongue pieces that are elastically deformable.

6. A connector according to claim 5, wherein said one end portion of said leaf-like spring member is formed to have strips such that every other strip forms a hook-shaped catch portion and remaining strips form second tongue pieces to urge against the electric wire peel portions.

7. A connector according to claim 5, wherein said contact element has electric wire insertion holes through which distal ends of the peeled electric wire portions extend, and said holder for incorporating said contact element is made of a transparent heat-resistant insulating synthetic resin material so that the distal ends of the peeled electric wire portions extending through said contact element can be visually confirmed from an outside of said holder.

8. A connector according to claim 1, wherein said leaf-like spring member has a plurality of tongue pieces that are formed to have a strip shape at a second end, and said peeled electric wire portions are inserted into said electric wire insertion holes formed at the proximal end portion of said conductive plate, and are clamped under pressure between the first bent piece of the conductive plate and the tongue piece portions that are elastically deformable such that they can be connected with the other electric wires.

* * * * *